US010801178B2

(12) United States Patent
Kumbhar et al.

(10) Patent No.: US 10,801,178 B2
(45) Date of Patent: Oct. 13, 2020

(54) WORK TOOL ATTACHMENT FOR A WORK MACHINE

(71) Applicant: DEERE & COMPANY, Moline, IL (US)

(72) Inventors: Nilesh Kumbhar, Karad (IN); Michael Tigges, Dubuque, IA (US); Brett Graham, Dubuque, IA (US); Jason Simmons, Platteville, WI (US); Nicholas Rokusek, Dubuque, IA (US); Anil Sharma, Jaipur (IN)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 16/213,685

(22) Filed: Dec. 7, 2018

(65) Prior Publication Data

US 2020/0181872 A1 Jun. 11, 2020

(51) Int. Cl.

| | |
|---|---|
| ***E02F 3/76*** | (2006.01) |
| ***E02F 3/34*** | (2006.01) |
| ***E02F 3/96*** | (2006.01) |

(52) U.S. Cl.

CPC ..... *E02F 3/7609* (2013.01); *E02F 3/3414* (2013.01); *E02F 3/7613* (2013.01); *E02F 3/7618* (2013.01); *E02F 3/96* (2013.01)

(58) Field of Classification Search

CPC ..... E02F 3/7609; E02F 3/7613; E02F 3/7618; E02F 3/414

See application file for complete search history.

(56) References Cited

U.S. PATENT DOCUMENTS

| | | | | |
|---|---|---|---|---|
| 2,732,963 A * | 1/1956 | Grubich | B60R 21/11 414/699 |
| 3,059,356 A * | 10/1962 | Lorang | E02F 3/7613 172/821 |
| 3,199,236 A * | 8/1965 | Bartel et al. | B62D 49/04 172/817 |
| 3,400,767 A * | 9/1968 | Hermiz | E02F 3/7613 172/820 |
| 3,662,838 A * | 5/1972 | Polzin et al. | E02F 3/7613 172/823 |

(Continued)

FOREIGN PATENT DOCUMENTS

EP 3363955 A2 8/2018

OTHER PUBLICATIONS

German Search Report issued in counterpart application No. 102019219097.9 dated Jul. 27, 2020 (10 pages).

*Primary Examiner* — Tara Mayo-Pinnock

(57) ABSTRACT

A work machine comprising a frame and a ground-engaging mechanism, the ground-engaging mechanism configured to support the frame on a surface, a boom assembly coupled to the frame, the boom assembly having a pair of boom arms pivotally coupled to the frame and moveable relative to the frame by a pair of boom hydraulic cylinders, an attachment coupler coupled to a distal section of the boom arms, and an attachment. The attachment comprises a work tool. The work tool is coupled to the C-frame. A pair of first C-frame sections are pivotally coupled to the frame of the work machine, and a second C-frame section is pivotally coupled to the attachment coupler, wherein actuating the pair of boom hydraulic cylinders engages the boom arms, pitching the attachment upwards or downwards.

6 Claims, 10 Drawing Sheets

(56) References Cited

U.S. PATENT DOCUMENTS 3,729,844 A * 5/1973 Deglan ..... E02F 3/401 37/408
4,013,132 A * 3/1977 Matsuzawa ..... E02F 3/7613 172/821
4,076,080 A * 2/1978 Anderson ..... E02F 3/7613 172/247
4,083,414 A * 4/1978 Yokoyama et al. .. E02F 3/7613 172/821
4,217,963 A 8/1980 Freese et al.
4,221,267 A * 9/1980 Asal et al. ..... E02F 3/7613 172/821
4,241,794 A * 12/1980 Halterman, Jr. ..... E02F 3/7613 172/818
4,281,721 A * 8/1981 Beales ..... E02F 3/8157 172/821
4,337,837 A * 7/1982 Nissen ..... E02F 3/7613 172/822
4,364,439 A * 12/1982 Asal ..... E02F 3/7613 172/821
4,562,891 A * 1/1986 Ranner ..... E01H 5/06 172/821
4,848,483 A * 7/1989 Heiple ..... E02F 3/7609 172/821
5,058,685 A * 10/1991 Moffitt ..... E02F 3/7613 172/820
5,181,574 A * 1/1993 Dion ..... E02F 3/7618 172/816
5,447,204 A * 9/1995 Asal et al. ..... E02F 3/7613 172/821
5,484,250 A 1/1996 Gilmore, Jr. et al.
5,829,337 A 11/1998 Barden
6,105,682 A * 8/2000 Recker et al. ..... E02F 3/7618 172/811
6,477,964 B1 11/2002 Tygard
7,204,656 B2 4/2007 Bjuhr
8,118,111 B2 2/2012 Armas
9,643,826 B2 5/2017 Kaneko et al.
9,656,840 B2 5/2017 Oiwa et al.
10,407,867 B2 * 9/2019 Wyss et al. ..... E02F 3/7618
10,533,300 B1 1/2020 Armas
2001/0037588 A1 * 11/2001 Royer ..... E02F 3/7613 37/403
2015/0084309 A1 * 3/2015 Kuboushek et al. .... B60D 5/00 280/400
2017/0145654 A1 5/2017 van Amelsfoort et al.
2017/0369295 A1 12/2017 Tygard

* cited by examiner

WORK TOOL ATTACHMENT FOR A WORK MACHINE

CROSS-REFERENCE TO RELATED APPLICATIONS

N/A

FIELD OF THE DISCLOSURE

The present disclosure relates to an improved work tool attachment configured for ease of use with a work machine.

BACKGROUND

Work machines, including crawler dozers, loaders, excavators, utility vehicles, tractors, and road pavers, to name a few, are generally vehicles comprising a boom that can be manipulated to perform a variety of functions. One of the challenges in the use of work machines are the large number of different work machines with their respective functions, control systems, user input parameters, standardized attachments, and their respective dependencies. Another challenge is that typically a plurality of different attachments catered towards different functionalities may be coupled with several work machines.

Various issues exist for this problem. Operators of skid steers, crawler dozers, loaders and track loaders, for example, perform a myriad of functions using different attachments, using hand and/or foot controls on the user input interface. Both compact track loaders and crawler dozers have the ability to couple to a variety of attachments wherein some attachments may be of standardized use on one work machine, and another attachment may be of standardized use on another work machine. Furthermore, both work machines differ in size and maneuverability thereby impacting the work environments each respective machine is capable of accessing, and functioning in. When an attachment, such as a blade commonly found on a crawler dozer, is coupled to a compact track loader, the mechanical configuration of the attachment and coupling with the compact track loader may not be optimal. There may be issues with the visibility, weight ratios, inefficiencies in the kinematic linkage, etc.

Therein lies a need to for an improved work tool attachment for adaptation for to a smaller work machine such as the compact track loader. The following disclosure addresses this issue.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes an apparatus for a work tool attachment for a work machine, an apparatus of the work machine, and a method of coupling the work tool attachment to a work machine.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

The work machine may comprise a frame and a ground-engaging mechanism, the ground-engaging mechanism configured to support the frame on a surface; a boom assembly coupled to the frame, the boom assembly having a pair of boom arms pivotally coupled to the frame and moveable relative to the frame by a pair of boom hydraulic cylinders; an attachment coupler, the attachment coupler coupled to a distal section of the boom arms; and an attachment comprising a work tool, and an attachment comprising a work tool, a C-frame, the work tool coupled to the C-frame, a pair of first C-frame sections pivotally coupled to the frame of the work machine, and a second C-frame section pivotally coupled to the attachment coupler, wherein actuating the pair of boom hydraulic cylinders engages the boom arms, pitching the attachment upwards or downwards.

The attachment may further comprise of auxiliary hydraulic cylinders, wherein actuating the auxiliary hydraulic cylinders performs one or more tilting the work tool relative to the work machine in a direction or roll about the forward portion of the boom assembly, and angling the work tool relative to the work machine in a direction of yaw about the forward portion of the boom assembly.

The pair of first C-frame sections may be pivotally coupled to either the track frame section or the mainframe section of the frame, wherein each first C-frame section is pivotally coupled to the frame with a releasable coupling.

The releasable coupling may comprise a bolt block assembly where the bolt block assembly comprises of one or more of a male coupling and a female coupling to engage one or more of a male coupling counterpart and a female coupling counterpart.

The work tool may be a blade.

The second C-frame section may be pivotally to the attachment coupler with a lifting linkage, wherein the lifting linkage is coupled to the second C-frame section on a first lifting linkage section of the lifting linkage and coupled to the attachment coupler on a second lifting linkage section of the lifting linkage.

The method of coupling the attachment to the work machine is as follows. The work machine may have a frame and a ground-engaging mechanism wherein the ground-engaging mechanism is configured to support the frame on a surface. The boom assembly may be coupled to the frame. The boom assembly may have a pair of boom arms pivotally coupled to the frame moveable relative to the frame by a pair of boom hydraulic cylinders, and an attachment coupler. The attachment coupler may be pivotally coupled to a distal section of the boom arms and moveable relative to the frame by a pair of attachment hydraulic cylinders. The attachment coupler may comprise a lifting linkage. The attachment may comprise a work tool, a C-frame, the work tool coupled to the C-frame, a pair of first C-frame sections with a first releasable coupling, and a second C-frame section with a second releasable coupled.

The method may comprise a first step of actuating the pair of boom hydraulic cylinders to extend so as to lower the boom assembly towards the surface. A next step may comprise of moving the work machine toward the attachment to align the track frame of the frame of the work machine with the pair of first C-frame sections and the attachment coupler with the second C-frame section. A next step is pivotally locking the attachment coupler to the second releasable coupling, and then actuating the pair of attachment hydraulic cylinders to retract to pitch the attachment coupler upwards and advance the pair of first C-frame sections towards the first releasable coupling. Finally, the method may include locking the pair of first C-frames sections to the track frame.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, "based on" means "based at least in part on" and does not mean "based solely on," such that it neither excludes nor requires additional factors.

Figure 1:
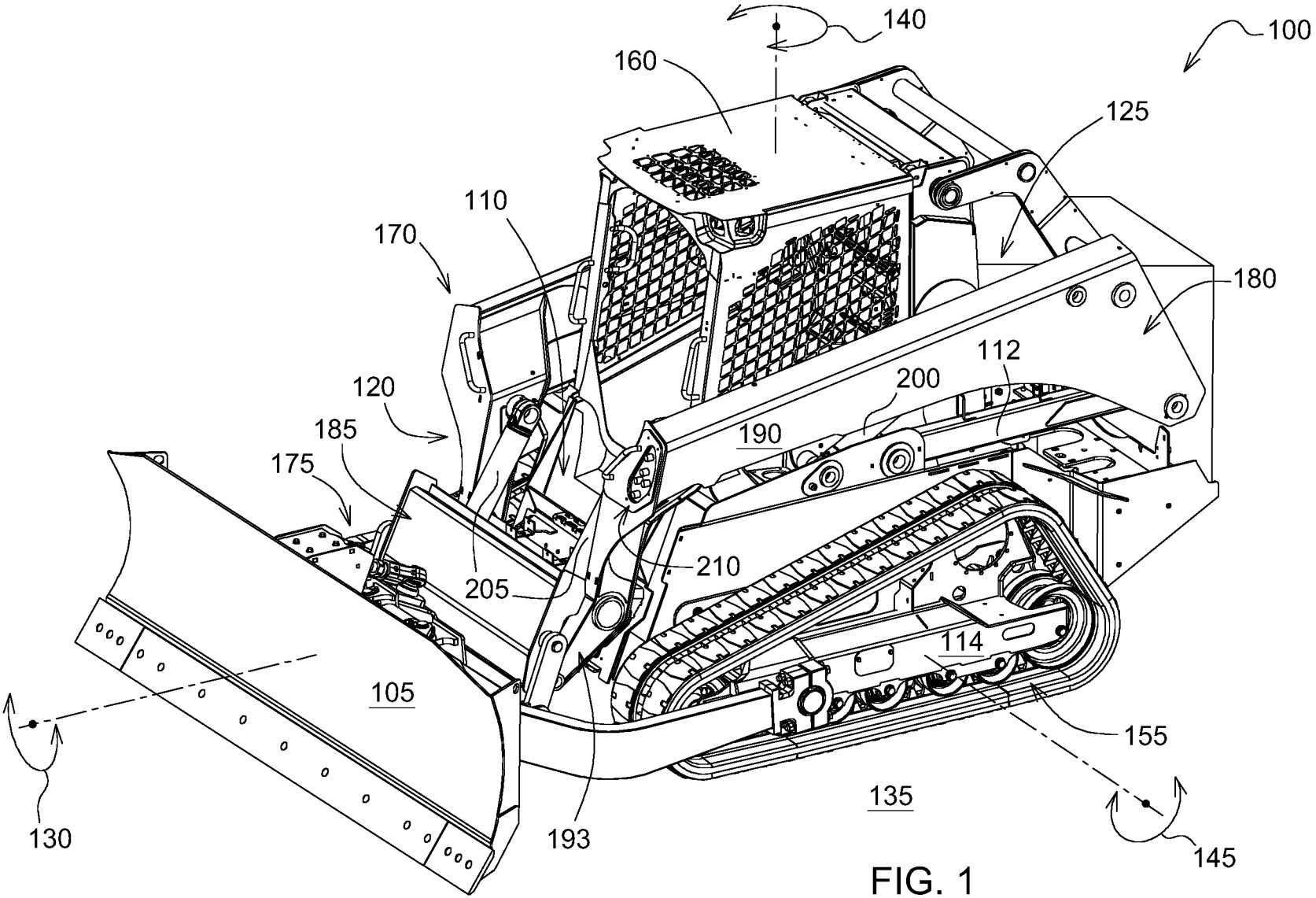
FIG. 1 is a perspective view of a compact track loader work machine according to a first embodiment of the present disclosure.

FIG. 1 illustrates a work machine 100 depicted as a compact track loader with an attachment 105 operatively coupled to the work machine 100. It should be understood, however, that the work machine could be one of many types of work machines, including, and without limitation, a skid steer, a backhoe loader, a front loader, a bulldozer, and other construction vehicles. The work machine 100, as shown, has a frame 110, having a front-end section 120, or portion, and a rear-end portion 125. The work machine includes a ground-engaging mechanism 155 that supports the frame 110 and an operator cab 160 supported on the frame 110, the ground-engaging mechanism 155 configured to support the frame 110 on the surface 135.

The engine 165 (shown in FIG. 2) is coupled to the frame 110 and is operable to move the work machine 100. The illustrated work machine 100 includes tracks, but other embodiments may include one or more wheels that engage the surface. Work machine 100 may be operated to engage the surface 135 and cut and move material to achieve simple or complex features on the surface. As used herein, directions with regard to work machine 100 may be referred to from the perspective of an operator seated within the operator cab 160; the left of work machine 100 is to the left of such an operator, the right of work machine is to the right of such an operator, the front or fore of work machine is the direction such an operator faces, the rear or aft of work machine is behind such an operator, the top of work machine is above such an operator, and the bottom of work machine below such an operator. The operator faces in the directions towards the attachment 105. In order to turn, the ground-engaging mechanism 155 on the left side of the work machine 100 may be operated at a different speed, or in a different direction, from the ground-engaging mechanism 155 on the right side of the work machine 100. In a conventional compact track loader, the operator can manipulate controls from inside an operator cab 160 to drive the tracks on the right or left side of the work machine 100. The movement for work machine 100 may be referred to as roll 130 or the roll direction, pitch 145 or the pitch direction, and yaw 140 or the yaw direction.

The work machine 100 comprises a boom assembly 170 coupled to the frame 110. An attachment 105, or work tool, may be pivotally coupled at a forward portion 175 of the boom assembly 170, while a rear portion 180 of the boom assembly 170 is pivotally coupled to the frame 110. The frame 110 comprises a mainframe 112 and a track frame 114 (alternative embodiments comprising other work machines may have other ground-engaging frames). The attachment 105 may be coupled to the boom assembly 170 through an attachment coupler 185. One exemplary attachment coupler 185, often referred to as Deere and Company's Quik-Tatch, is an industry standard configuration and a coupler universally applicable to many Deere attachments and several after-market attachments. The attachment coupler 185 may be coupled to a distal section of the boom arms 193, or more specifically the forward portion of the boom assembly 175.

The boom assembly 170 comprises a first pair of boom arms 190 (one each on a left side and a right side) pivotally coupled to the frame 110 and moveable relative to the frame 110 by a pair of boom hydraulic cylinders 200, wherein the pair of boom hydraulic cylinders 200 may also conventionally be referred to as a pair of lift cylinders (one coupled to each boom arm) for a compact track loader. The attachment coupler 185 may be coupled to a forward section, or portion, of the pair of boom arms 190, being moveable relative to the frame 110 by a pair of tilt hydraulic cylinders 205. The frame 110 of the work machine 100 further comprises a hydraulic coupler 210 on the front-end portion 120 of the work machine 100 to couple one or more auxiliary hydraulic cylinders (shown in FIGS. 2, 4 and 8) to drive movement of or actuate auxiliary functions of an attachment 105. The attachment coupler 185 enables the mechanical coupling of the attachment 105 to the frame 110. The hydraulic coupler 210, contrary to the attachment coupler 185, enables the hydraulic coupling of an auxiliary hydraulic cylinder(s) 215 on the attachment 105 to the hydraulic system 220 (shown in FIG. 2) of the work machine 100. Please note that not all attachments have one or more auxiliary hydraulic cylinders and therefore will not use the hydraulic coupler 210. Alternatively, uses for the hydraulic coupler 210 include opening or closing a grapple type attachment, or spinning a roller brush type attachment. In the embodiment described in detail below, the hydraulic coupler 210 is used in conjunction with an attachment 105, the attachment in the present embodiment comprising a blade 322 to mimic the function of a dozer crawler.

Each of the pair of boom hydraulic cylinders 200, the pair of tilt hydraulic cylinders 205, and the auxiliary cylinders 215 (found on the attachments of embodiments shown herein) are double acting hydraulic cylinders. One end of each cylinder may be referred to as a head end, and the end of each cylinder opposite the head end may be referred to as a rod end. Each of the head end and the rod end may be fixedly coupled to another component, such as a pin-bushing or pin-bearing coupling, to name but two examples of pivotal connections. As a double acting hydraulic cylinder, each may exert a force in the extending or retracting direction. Directing pressurized hydraulic fluid 235 into a head chamber of the cylinders will tend to exert a force in the extending direction, while directing pressurized hydraulic fluid 235 into a rod chamber of the cylinders will tend to exert a force in the retracting direction. The head chamber and the rod chamber may both be located within a barrel of the hydraulic cylinder, and may both be part of a larger cavity which is separated by a moveable piston connected to a rod of the hydraulic cylinder. The volumes of each of the head chamber and the rod chamber change with movement of the piston, while movement of the piston results in extension or retraction of the hydraulic cylinder. The control of these cylinders will be described in further detail with regards to FIG. 2.

Figure 2:
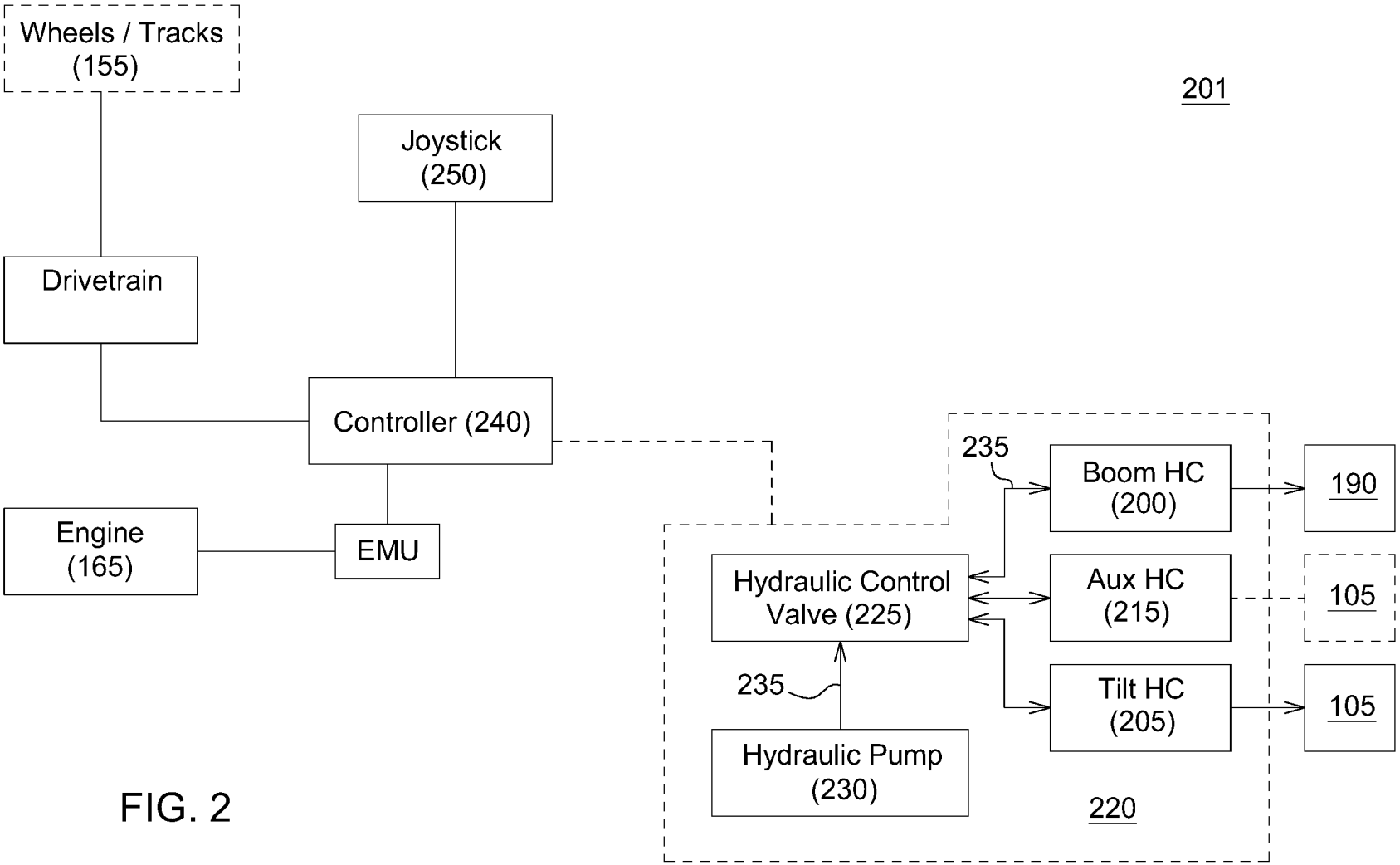
FIG. 2 is a schematic of the hydraulic system and other parts of the compact track loader of FIG. 1, according to the embodiments disclosed herein.

FIG. 2 is a schematic of a portion of an attachment-configurable control system 201 for controlling the hydraulic cylinders (200, 205, 215) as it relates to the components of the work machine 100 of FIG. 1, the system including hydraulic and electrical components. Each of the pair of boom hydraulic cylinders 200, pair of tilt hydraulic cylinders 205, and the auxiliary hydraulic cylinder(s) 215 are coupled to hydraulic control valve 225, which may be positioned in a portion of the work machine 100. Hydraulic control valve 225 may also be referred to as a valve assembly or manifold. Hydraulic control valve 225 receives pressurized hydraulic fluid 235 from hydraulic pump 230, which generally may be coupled to the engine 165 or alternative power source, and directs such hydraulic fluid 235 to the pair of boom hydraulic cylinders 200, the pair of tilt hydraulic cylinders 205, the auxiliary hydraulic cylinder (s) 215, and other hydraulic circuits or functions of the work machine (e.g. the hydrostatic drive motors for the left and right-side tracks). Hydraulic control valve 225 may meter such fluid out, or control the flow rate of hydraulic fluid 235 to each hydraulic circuit to which it is connected. Alternatively, hydraulic control valve 225 may not meter such fluid out but may instead only selectively provide flow to these functions while metering is performed by another component (e.g. a variable displacement hydraulic pump). Hydraulic control valve 225 may meter such fluid out through a plurality of flow paths or spools, whose positions control the flow of hydraulic fluid 235, and other hydraulic logic. The spools may be actuated by solenoids, pilots (e.g. pressurized hydraulic fluid acting on the spool), the pressure upstream or downstream of the spool, or some combination of these or other uses. The controller 240 of the work machine 100 actuates these solenoids by sending a specific current to each (e.g. 600 mA). In this way, the controller 240 may actuate an attachment 105 by issuing electrical command signals to direct hydraulic fluid 235 flow from the hydraulic pump 230 to one or more of the pair of boom hydraulic cylinders 200, the pair of tilt hydraulic cylinders 205, and the auxiliary cylinder(s) 215.

Controller 240, which may also be referred to as a vehicle control unit (VCU), is in communication with a number of components on the work machine 100, including the hydraulic system 220, electrical components such as the user input interface 245 from within the operator cab 160, and other components. Controller 240 is electrically coupled to these other components by a wiring harness such that messages, commands, and electrical power may be transmitted between controller 240 and the remainder of the work machine 100. Controller 240 may be coupled to other controllers, such as the engine control unit (ECU), through a controller area network (CAN). Controller may then send and receive messages over the CAN to communicate with other components of the CAN. The controller 240 may send command signals to actuate the attachment 105 by sending a command signal to actuate an input from the user input interface 245 from the operator cab 160 (shown in FIG. 1). For example, an operator may use a joystick 250 to issue command to actuate an attachment 105, and the joystick 250 may generate hydraulic pressure command signals communicated to hydraulic control valve 225 to cause actuation of the attachment 105. In such a configuration, controller 240 may be in communication with electrical devices (solenoids, motors) which may be actuated by a joystick 250 in operator cab 160. Other alternative inputs on a user input interface 245 with electric, or hydraulic pressure command signals may include switches, buttons, roller tabs, sliding tabs, infinity switches, touchscreens, foot pedals, virtual operative signaling, to name a few.

The hydraulic system 220, communicatively coupled to the controller 240, is configured to operate the work machine 100 and operate the attachment 105 coupled to the work machine 100, including, without limitation, the attachment's lift mechanism, tilt mechanism, pitch mechanism, roll mechanism, and auxiliary mechanisms, for example. This may also include moving the work machine 100 in forward and reverse directions, moving the work machine left and right, and controlling the speed of the work machine's travel. Summarily, the hydraulic pump 230 may be coupled to one or more of the pair of boom hydraulic cylinders 200, the pair of tilt hydraulic cylinders 205, and auxiliary hydraulic cylinder(s) 215. The auxiliary hydraulic cylinder(s) 215 may actuate an attachment 105. The auxiliary hydraulic cylinders 215 are generally found on the attachment 105 for the embodiments described herein. The auxiliary hydraulic cylinders 215 may perform one or more of tilting the blade 322 relative to the work machine 100 in a direction of roll 130 about the forward portion of the boom assembly 175, and angling blade 322 relative to the work machine in a direction of yaw 140 about the forward portion of the boom assembly 175.

The hydraulic pump 230 may deliver hydraulic fluid 235 through the plurality of flow paths, the plurality of flow paths coupled to one or more of the pair of boom hydraulic cylinders 200, the pair of tilt hydraulic cylinder 205, and the auxiliary hydraulic cylinder(s) 215.

Figure 3:
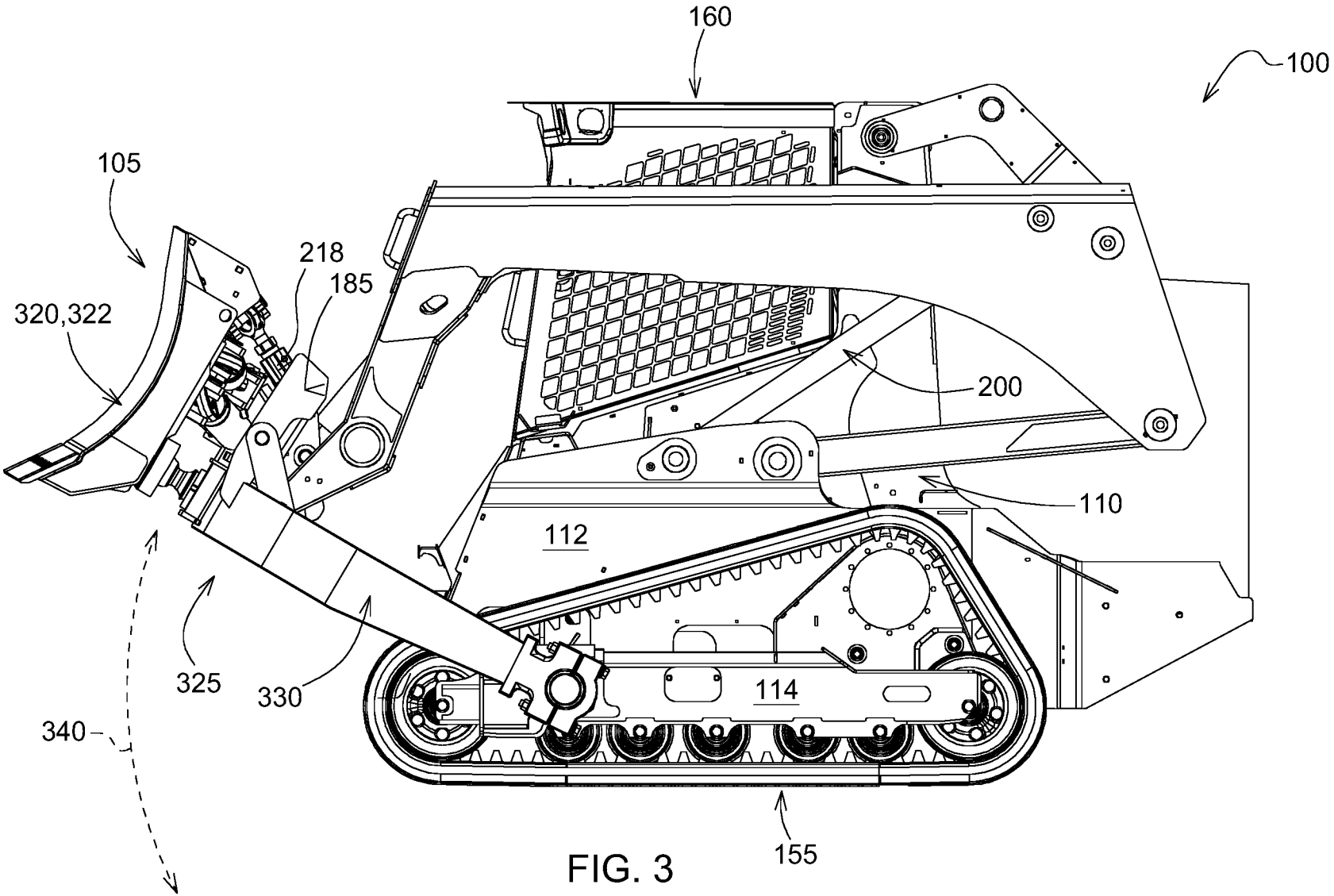
FIG. 3 is a side view of the embodiment disclosed in FIG. 1 with the boom cylinders extended.
Figure 4:
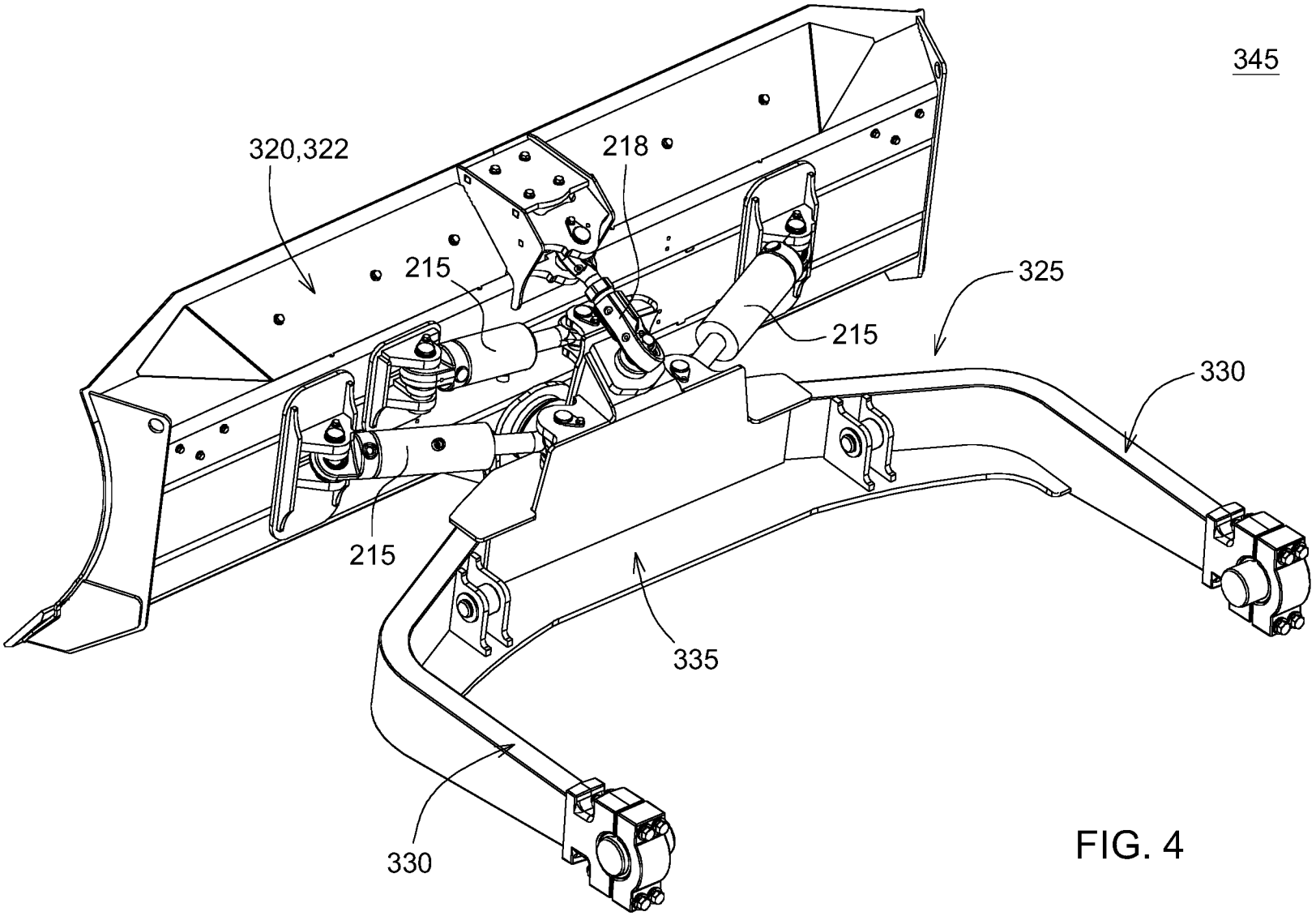
FIG. 4 is a perspective view of the work tool attachment only according to the first embodiment shown in FIG. 1.

Now turning to FIGS. 3 and 4 with continued reference to FIGS. 1 and 2, the attachment comprises a work tool 320, and a C-frame 325 wherein the work tool is coupled to the C-frame. The work tool 320 in the present embodiment being a blade 322. A pair of first C-frame sections 330 (one each on a left and a right side of the work machine 100) are pivotally coupled to the frame 110 of the work machine 100, and second C-frame section 335 is pivotally coupled to the attachment coupler 185, wherein actuating the pair of boom hydraulic cylinders 200 engages the boom arms 190, pitching the attachment 105 upwards or downwards, in the direction of pitch 145, along the trajectory shown in the dotted line 340. This mechanism advantageously allows the work tool 320 to use the pair boom hydraulic cylinders 200 as opposed to the tilt hydraulic cylinders 205 for pitching work tool 320 upwards or downwards to control the depth of cut into the surface 135 during dozing type operations. Boom hydraulic cylinders 200 are less sensitive than tilt hydraulic cylinders 205 thereby more effective in precision grading operations. The work tool 320, in particular the blade, is an attachment which may engage the ground or material to move or shape it. Work tool 320 may be used to move material from one location to another and to create features on the ground, including flat area, grades, hills, roads, or more complexly shaped features. In the embodiment shown, the work tool 320 may be referred to as a six-way blade 322, six-way adjustable blade, or pitch-angle-tilt (PAT) blade. Work tool 320 may be hydraulically actuated to pitch upwards or downwards in the direction of pitch 145, roll left or roll right in the direction of roll 130 (which may be referred to tilt left and tilt right), and angle left or angle right in the direction of yaw 140 (which may be referred to as blade angle, or yaw left or yaw right). Alternative embodiments may utilize a work tool 320 with fewer hydraulically controlled degrees of freedom, such as a 4-way blade that may not be angled, or actuated in the direction of yaw 140.

Several other advantages of using the boom hydraulic cylinders 200 for pitching the attachment 105 upwards and downwards as opposed to using the tilt hydraulic cylinders 205, ease of controlling the linkage because the track frame 114 (undercarriage) of a compact track loader is significantly shorter in the fore-aft direction than a crawler dozer thereby movement of the pair of boom arms 190 through the boom hydraulic cylinders provides improved incremental depth control of the work tool 320 because of the longer torque arm of both the pair of boom arms 190 and the C-frame 325; and overall improved penetration into the surface 135 because coupling the attachment 105 directly to the frame 110, and not the boom provides improved rigidity for dozing applications.

According to a first embodiment 345 shown in FIGS. 3 and 4, the pair of first C-frame sections 330 may be coupled to the track frame sections 114 of the frame 110, on a left side and a right side of the work machine 100. Track frame 114 in the context of this disclosure may refer to the frame portion of the ground-engaging mechanism 155 such as the frame 110 supporting the track of the compact track loader, or alternatively ground-engaging wheels of a skid steer (not shown). This feature is also commonly referred to as an undercarriage. Coupling directly to the frame 110 advantageously allows the reactive forces encountered by the attachment 105, or blade 322 as it grades the surface, to substantially or in a greater amount transmit through the frame 110 (may also be referred to as the undercarriage) of the work machine 100 as opposed through the boom assembly 170. The frame 110 of the work machine 100 spans a larger cross-sectional area in addition to having a shock absorbing system (e.g. springs, dampeners throughout) to absorb the reactive forces. Furthermore, the frame provides the increased rigidity for improved dozing performance. During a grading operation, the compact track loader is forwarded so that blade 322 is driven into earth, stones, gravel or similar material. In one exemplary embodiment, the blade is operated optimally at a pitch angle of approximately 56 degrees relative to the surface 135 for efficient grading. This optimal pitch angle will vary based on the conditions of the surface 135 (e.g. moisture, hardness, stickiness). Please note this angle may be modified prior to using the work machine by a pitch link 218, or of a similar mechanism. This angling of the blade 322 subjects the work machine 100 to a counterforce from the load presented by engaging ground material. Coupling directly to the frame 110 provides an alternative load path for the reactive forces to be dispersed. Coupling the first sections of the C-frame 330 to the frame 110 of the work machine 100 reduces the reactive forces and stress on the attachment coupler 185 and subsequently the boom assembly 170, or any other means of coupling the attachment 105 to the work machine 100, thereby increasing the working life of the coupling mechanism (e.g. the attachment coupler 185, or the ball joint portion of the coupling mechanism 185) and increasing the stability of the blade 322 or the useful life of the blade 322.

Figure 7:
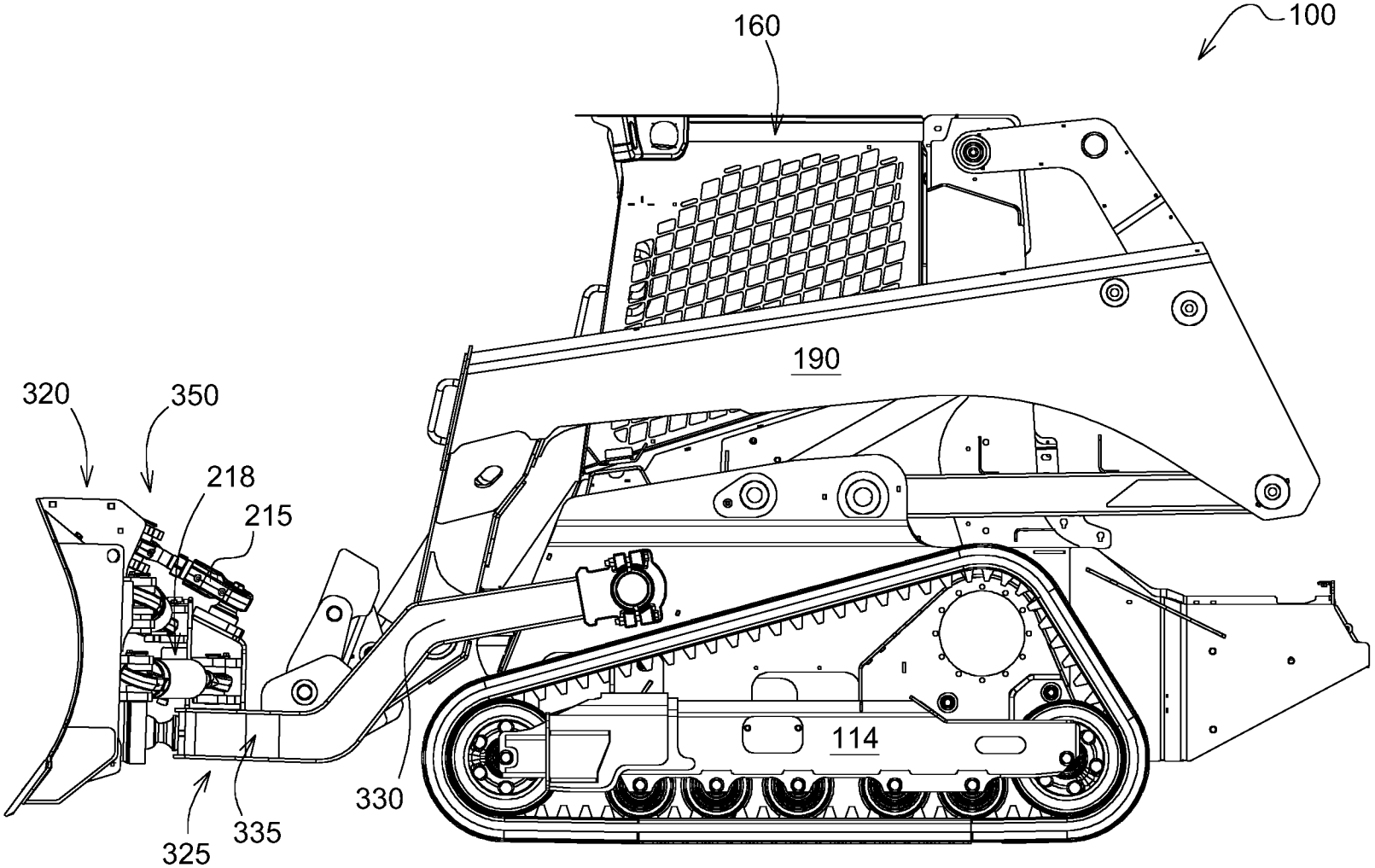
FIG. 7 is a side view of a compact track loader of a work machine according to a second embodiment of the present disclosure.
Figure 8:
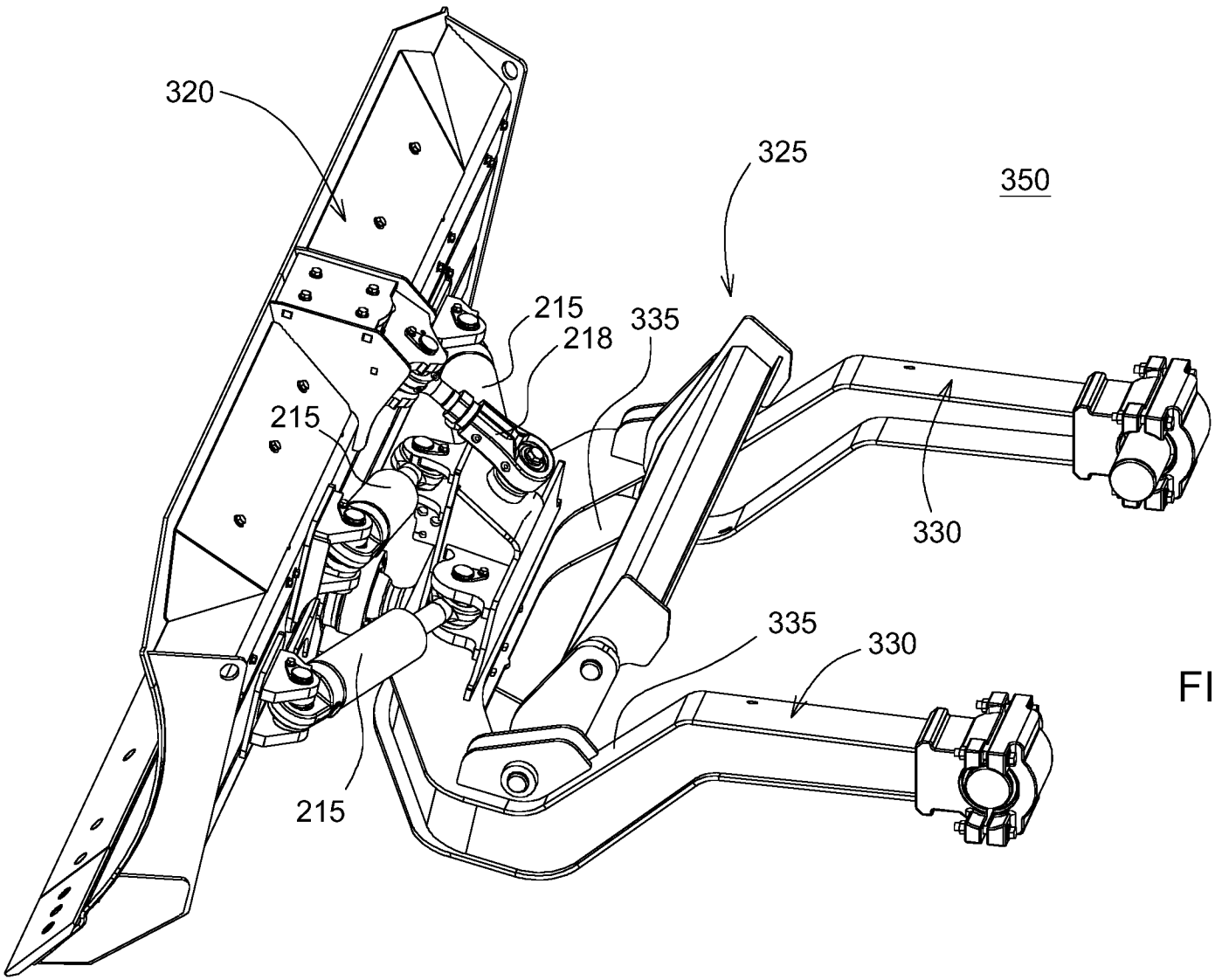
FIG. 8 is a perspective view of the work tool attachment only according to the second embodiment shown in FIG. 7.

Alternatively, as shown in a second embodiment 350 in FIGS. 7 and 8, the pair of first C-frame sections 330 may be coupled to the mainframe 112 of the frame 110 of the work machine 100. As shown in the side view of work machine coupled to the attachment in FIG. 7 and perspective view of a second embodiment 350 of the attachment alone in FIG. 8, the pair of first C-frame sections 330 are S-shaped allowing for coupling the C-frame 325 at a height greater than six inches from the ground, advantageously reducing wear and abrasion from the C-frame 325 by reducing potential for contact with the surface 135. In both the first embodiment 345 and the second embodiment 350, the increased rigidity improves the effective dozing performance. The C-frame 325 reinforces support of work tool 320 in maintaining the desired orientation, instead of singularly relying on the ball joint and hydraulic cylinders coupling to the boom arms 190.

Figure 6:
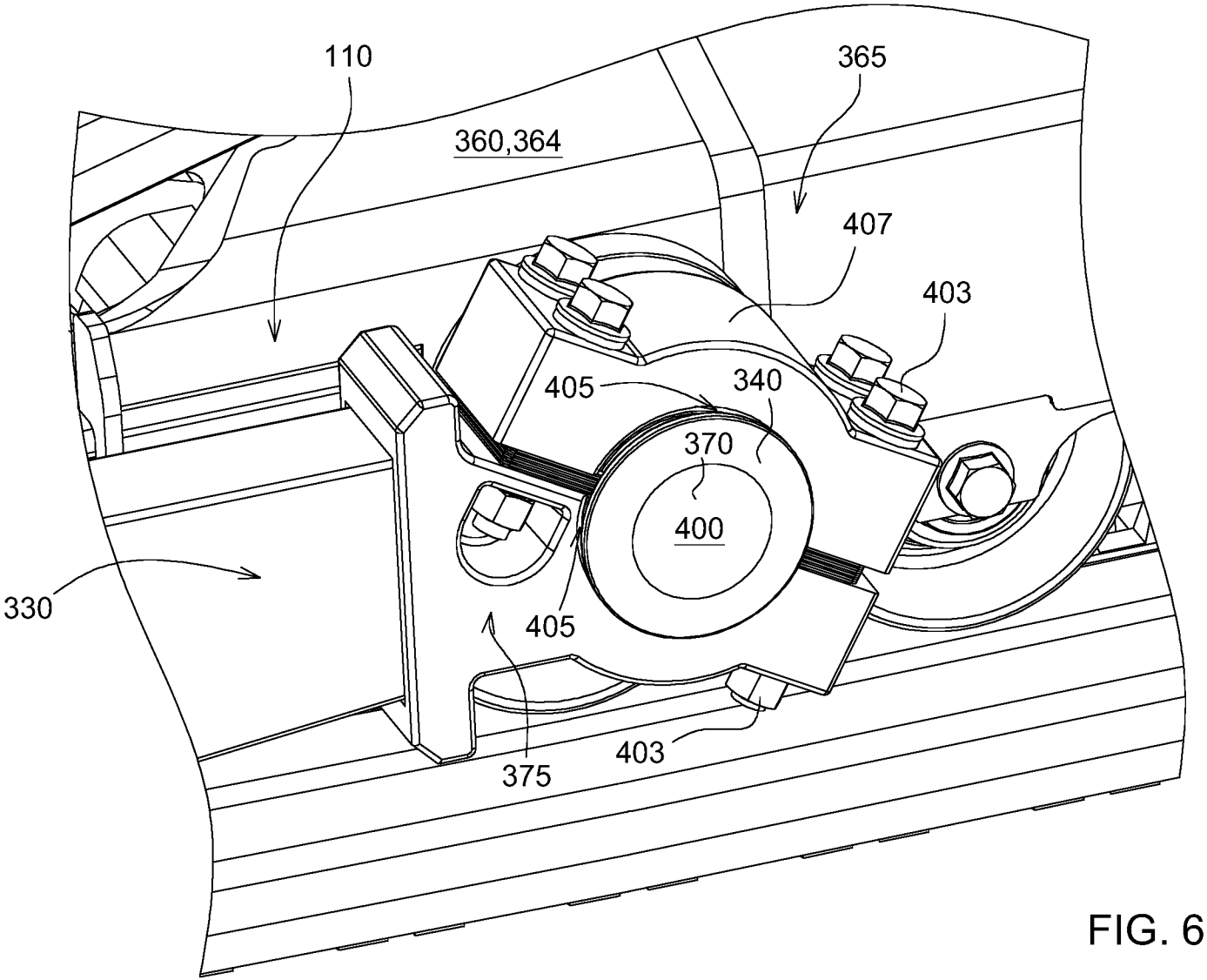
FIG. 6 is a detailed view of the C-frame coupling to the track frame according to the first embodiment.

Now turning to FIG. 6, each first C-frame section 330 may be pivotally coupled to the frame 110 with a releasable coupling 360 (the figure represents a left side of the work machine 100 wherein a mirror image of the releasable coupling also exists on a right side of the work machine 100). The releasable coupling 360 of the present embodiment may also be referred to as a first releasable coupling 364. The first releasable coupling 364 comprises of a bolt block assembly 365 wherein the bolt block assembly 365 comprises one or more of a male coupling 370 (male coupling counterpart) and a female coupling 375 to engage one or more of a female coupling 375 (a female coupling counterpart). A detailed view of one embodiment of the bolt block assembly 365 shown in FIG. 6, comprises of a trunnion 400, two bearing halves 405 and a cap 407 (with two portions). The trunnion 400, also functioning as the male coupling 370, is a cylindrical protrusion used as a mounting or pivoting point for the C-frame 325 onto the frame 110. The trunnion 400, extending from the frame 110, particularly either the track frame 114 or the mainframe 112, may either be welded to an outer surface of the frame, or alternatively, removably coupled to the outer-surface of the frame 110. In one possible embodiment, the trunnion 400 may be bolted onto the surface, such that it is sufficiently durable to engage the C-frame 325 when coupled to the work machine, and removable when not in use, thereby advantageously allowing a smoother contour on a left and a right side of the work machine. The bolt assembly 365 further comprises two bearing halves 405 found in the spacing between the outer circumference of the trunnion 400 and the inner arches of the cap 407. The cap 407 comprises of two portions, one fixedly attached to or near and end of the first C-sections 330, the other removable from track frame. It is plausible, the other portion of the cap may not be removable. The cap 407 comprising of two portions are bolted together by hardware 403. The interface or boss split where the two portions of cap 407 come together may be angled to reduce shear loads on hardware 403.

Figure 5:
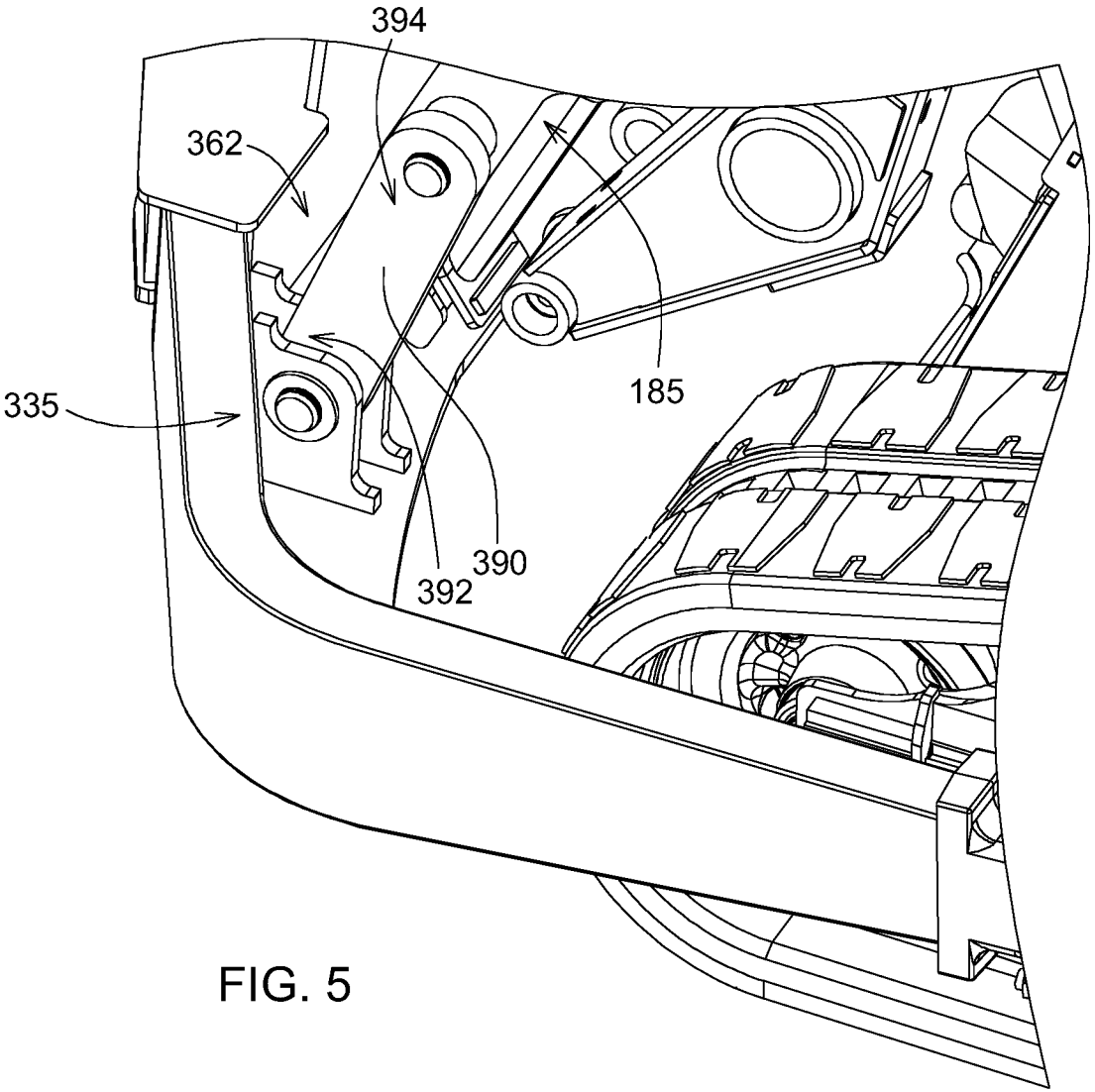
FIG. 5 is a detailed view of the C-frame coupling to the boom assembly used in both the first and the second embodiment of the present disclosure.

Now turning to FIG. 5, the second C-frame section 335 may be pivotally coupled to the attachment coupler 185 with a second releasable coupling 362, wherein a lifting linkage 390 is coupled to the second C-frame section 335 on a first lifting linkage section 392 of the lifting linkage 390 and coupled to the attachment coupler 185 on a second lifting linkage section 394 of the lifting linkage 390. The lifting linkage 390, in the embodiment shown, comprises of two respective coupling locations, one near a left side and one near a right side of the attachment coupler 185. However, multiple alternatives exist, wherein the lifting linkage 390 may comprise of a singular coupling location, or multiple coupling locations, or more than one link so long as there is sufficient strength for the attachment coupler 185 to remain engaged with the C-frame 325.

Figure 9:
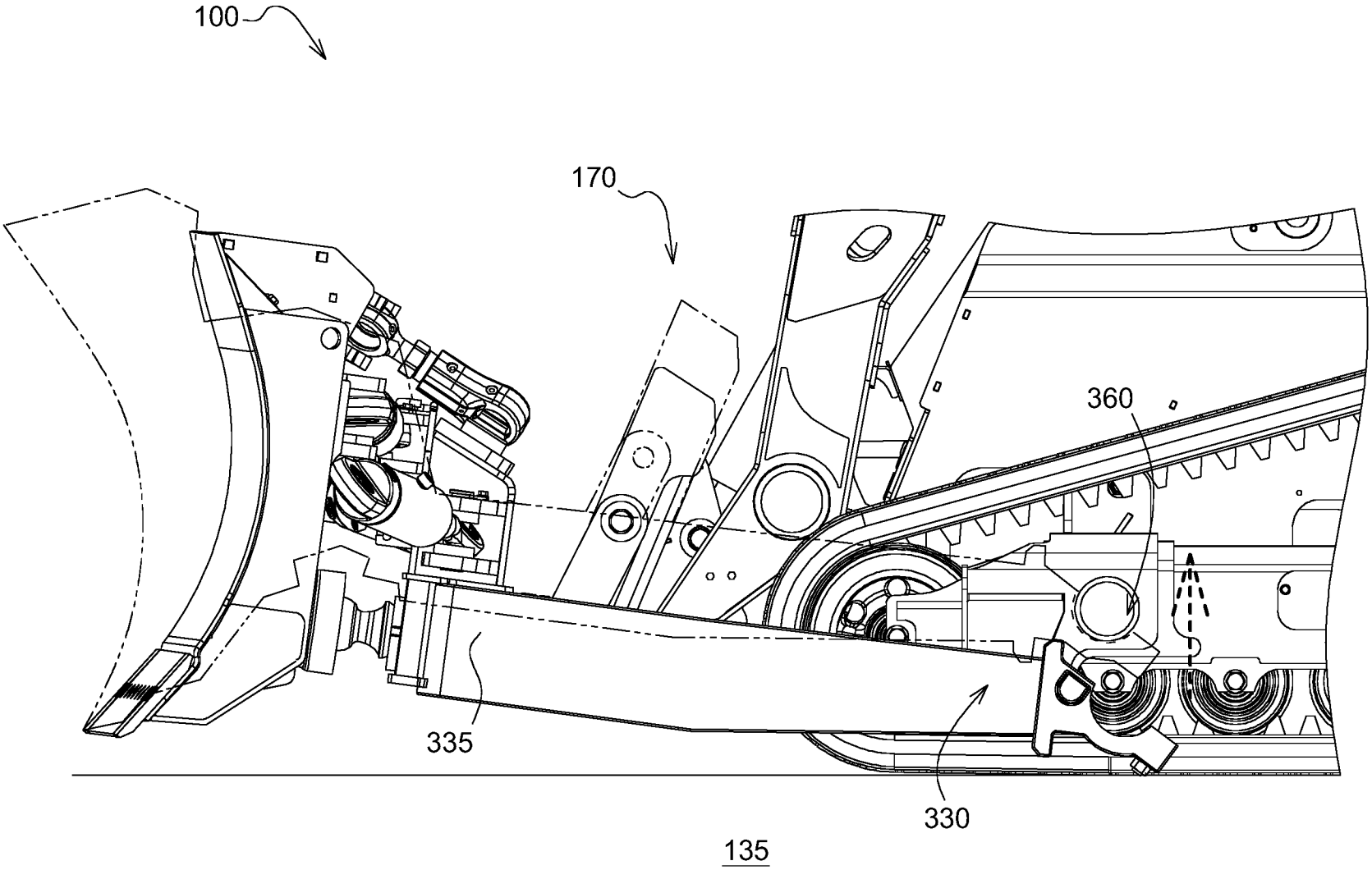
FIG. 9 is side view illustrative representation demonstrating the method of coupling the first embodiment of the present disclosure to a work machine.
Figure 10:
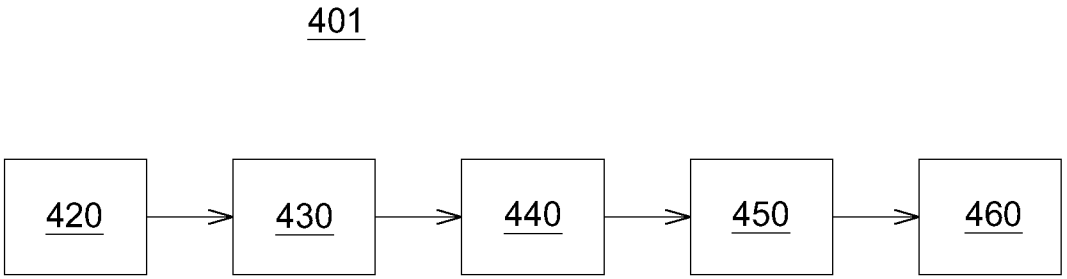
FIG. 10 is a flowchart detailing a method for coupling the first embodiment of the present disclosure to a work machine as illustrated in FIG. 9.

Now turning to FIGS. 9 and 10, with continued reference to FIG. 4-6, the following method 401 may be applicable to the first embodiment 345 of the attachment 105 shown in FIG. 4. The method 401 advantageously allows for an operator to single-handedly couple the attachment 105 to the work machine 100 in quick and efficient manner. FIG. 10 details a flowchart on the method of coupling 401 where in block 420, the operator actuates the pair of boom hydraulic cylinders 200 to extend so as to lower the boom assembly 170 towards the surface 135.

In block 430, the operator may move the work machine 100 toward the attachment so as to align the track frame 114 of the frame 110 of the work machine 100 with the pair of first C-frame sections 330, and align the attachment coupler 185 with the second C-frame section 335.

In block 440, the operator pivotally locks the lifting linkage 390 of the attachment coupler 185 to the second releasable coupling 362.

Subsequently, in block 450, the operator from the user input interface 245, actuates the pair of tilt hydraulic cylinders 205 to retract so as to pitch the attachment coupler 185 upwards and advance the pair of first C-frame sections 330 towards the first releasable coupling 360. Movement of a subsequent position of the attachment 105 when actuating tilt hydraulic cylinders 205 is represented by the dotted lines.

Finally, in block 460, with the pair of first C-frame sections 330 in place, the operator may lock or secure the pair of first C-frame sections 330 to the track frame 114 using the bolt block assembly 365 and associated hardware 403.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

The references "A" and "B" used with reference numerals herein are merely for clarification when describing multiple implementations of an apparatus.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. A work machine, comprising:

a frame and a ground-engaging mechanism, the ground-engaging mechanism configured to support the frame on a surface;

a boom assembly coupled to the frame, the boom assembly having a pair of boom arms pivotally coupled to a rear-end portion of the frame and moveable relative to the frame by a pair of boom hydraulic cylinders;

an attachment coupler, the attachment coupler coupled to a distal section of the boom arms; and an attachment comprising a work tool, a C-frame, the work tool coupled to the C-frame, a pair of first C-frame sections pivotally coupled to the frame of the work machine, and a second C-frame section pivotally coupled to the attachment coupler, the attachment further comprising auxiliary hydraulic cylinders, wherein actuating the auxiliary hydraulic cylinders performs tilting of the work tool relative to the work machine in a direction of roll about a forward portion of the boom assembly, and angling of the work tool relative to the work machine in a direction of yaw about the forward portion of the boom assembly; and wherein actuating the pair of boom hydraulic cylinders engages the boom arms, pitching the attachment upwards or downwards while each first C-frame section is pivotally coupled to the frame with the releasable coupling.

2. The work machine of claim 1, wherein the pair of first C-frame sections is pivotally coupled to a track frame of the frame.

3. The work machine of claim 1, wherein the pair of first C-frame sections is pivotally coupled to a mainframe of the frame.

4. The work machine of claim 1, wherein the releasable coupling comprises a bolt block assembly, the bolt block assembly comprising one or more of a male coupling and a female coupling to engage one or more of a male coupling counterpart and a female coupling counterpart.

5. The work machine of claim 1 wherein the work tool is a blade.

6. The work machine of claim 1, wherein the second C-frame section is pivotally coupled to the attachment coupler with a lifting linkage, wherein the lifting linkage is coupled to the second C-frame section on a first lifting linkage section of the lifting linkage and coupled to the attachment coupler on a second lifting linkage section of the lifting linkage.

* * * * *